US008091529B2

(12) United States Patent
Förster et al.

(10) Patent No.: US 8,091,529 B2
(45) Date of Patent: Jan. 10, 2012

(54) REGULATING METHOD FOR A VOLUME CONTROL

(75) Inventors: Christoph Förster, Kriftel (DE); Matthias Wiese, Aschaffenburg (DE)

(73) Assignee: Continental Automotive GmbH, Hannover (DE)

( * ) Notice: Subject to any disclaimer, the term of this patent is extended or adjusted under 35 U.S.C. 154(b) by 318 days.

(21) Appl. No.: 12/518,143

(22) PCT Filed: Nov. 20, 2007

(86) PCT No.: PCT/EP2007/062567

§ 371 (c)(1),
(2), (4) Date: Jun. 8, 2009

(87) PCT Pub. No.: WO2008/086909

PCT Pub. Date: Jul. 24, 2008

(65) Prior Publication Data

US 2010/0023244 A1 Jan. 28, 2010

(30) Foreign Application Priority Data

Dec. 6, 2006 (DE) ..... 10 2006 057 523

(51) Int. Cl.
*F02D 13/04* (2006.01)

(52) U.S. Cl. ..... 123/322; 318/434; 700/282

(58) Field of Classification Search ..... 123/321, 123/322, 345–348, 478, 480; 318/434, 796, 318/799; 700/282
See application file for complete search history.

(56) References Cited

U.S. PATENT DOCUMENTS

| | | | | |
|---|---|---|---|---|
| 4,445,075 | A * | 4/1984 | Fry | 318/434 |
| 5,317,499 | A | 5/1994 | Brakus | |
| 6,291,954 | B1 | 9/2001 | Joch et al. | |
| 2004/0145273 | A1 * | 7/2004 | Khoury et al. | 310/316.03 |
| 2010/0318231 | A1 * | 12/2010 | Forster et al. | 700/282 |

FOREIGN PATENT DOCUMENTS

| | | | |
|---|---|---|---|
| DE | 3529742 | A1 | 2/1987 |
| DE | 19858697 | A1 | 7/2000 |
| DE | 19916101 | A1 | 10/2000 |
| EP | 0526498 | B1 | 1/1995 |
| EP | 0964150 | A2 | 12/1999 |

OTHER PUBLICATIONS

International Search Report, PCT/EP2007/062567, 10 pages, Mar. 31, 2008.

* cited by examiner

*Primary Examiner* — John Kwon
(74) *Attorney, Agent, or Firm* — King & Spalding L.L.P.

(57) ABSTRACT

In a regulating method for controlling an electrical actuator, especially a valve for regulating a volume flow in an injection system for an internal combustion engine, a nominal value is set for an actuating variable of the actuator; the actuator is controlled by a pulse width-modulated electrical control signal with a pre-defined pulse duty factor and a pre-defined period for adjusting the desired nominal value of the actuating variable; a flow threshold value is determined according to the pre-defined nominal value for the actuating variable; the flow flowing through the actuator is continuously measured during the control by the control signal and before the end of the period; the measured flow is compared with the flow threshold value/and the flow flowing through the actuator is switched off before the end of the period of the control signal if the measured flow exceeds the current threshold value.

20 Claims, 3 Drawing Sheets

REGULATING METHOD FOR A VOLUME CONTROL

CROSS-REFERENCE TO RELATED APPLICATIONS

This application is a U.S. National Stage Application of International Application No. PCT/EP2007/062567 filed Nov. 20, 2007, which designates the United States of America, and claims priority to German Application No. 10 2006 057 523.7 filed Dec. 6, 2006, the contents of which are hereby incorporated by reference in their entirety.

TECHNICAL FIELD

The invention relates to a regulating method for operating an electric actuator as claimed in the main claim, in particular for a volume control valve in an injection system for an internal combustion engine.

BACKGROUND

Modern injection systems for internal combustion engines in motor vehicles generally have a high-pressure fuel circuit via which the injection valves of the internal combustion engine are supplied with fuel, there being disposed in the high-pressure fuel circuit a volume control valve (VCV) which lets through a particular volume flow of fuel depending on how it is operated. The volume control valve is customarily operated via an output stage by a pulse width modulated voltage signal whose duty factor is varied as a function of the desired degree of opening of the volume control valve. To control the operation of the volume control valve, the electric current flowing through the volume control valve and representing the degree of opening of the volume control valve is measured at the end of each period of the pulse width modulated control signal. Depending on the thus determined actual value of the current flowing through the volume control valve or rather of the corresponding degree of opening of the volume control valve, the duty factor of the pulse width modulated control signal is varied as part of a control process in order to set the desired degree of opening of the volume control valve.

The disadvantage of this known regulating method for operating the volume control valve is the dead time resulting from the fact that the control variable is only varied from one period to the next, but not within a period.

Another disadvantage of the known regulating method described above is the over- or undershooting of the volume control valve about the predefined setpoint value.

SUMMARY

According to various embodiments, the above described regulating method can be improved accordingly.

According to an embodiment, a regulating method for operating an electric actuator, in particular for a volume control valve in an injection system for an internal combustion engine, may comprise the following steps: a) Predefining a setpoint value for a manipulated variable of the actuator, b) Operating the actuator with a pulse width modulated electrical control signal having a predefined duty factor and a predefined period for setting the desired setpoint value of the manipulated variable, c) Determining a current limit value corresponding to the predefined setpoint value for the manipulated variable, d) Continuously measuring the current flowing through the actuator while the control signal is being applied and even before the end of the period, e) Comparing the measured current with the current limit value, and f) Switching off the current flowing through the actuator even before the end of the period of the control signal if the current measured exceeds the current limit value.

According to a further embodiment, to switch off the current through the actuator, the level of the pulse width modulated control signal can be changed, resulting in a corresponding change in the duty factor. According to a further embodiment, the pulse width modulated control signal may have a constant period. According to a further embodiment, the current limit value may be variably set as a function of the required setpoint value. According to a further embodiment, the current limit value may be independent of the comparison of the measured current with the current limit value. According to a further embodiment, the current flowing through the actuator may be measured by means of an analog-digital-converter. According to a further embodiment, a) the actuator is a volume control valve in an injection system of an internal combustion engine, and b) the manipulated variable is the degree of opening of the volume control valve. According to a further embodiment, the period of the control signal may be in the millisecond range, in particular in the range from 1 ms to 10 ms.

According to another embodiment, a computer program product may executes the regulating method as described above when it is loaded onto a control computer.

According to yet another embodiment, a control computer for an injection system of an internal combustion engine may comprise a program memory and, stored in said program memory, a computer program which executes the regulating method as described above.

BRIEF DESCRIPTION OF THE DRAWINGS

Other advantageous further developments will now be explained in greater detail in connection with the description of the preferred exemplary embodiment with reference to the accompanying drawings in which.

DETAILED DESCRIPTION

Figure 1:
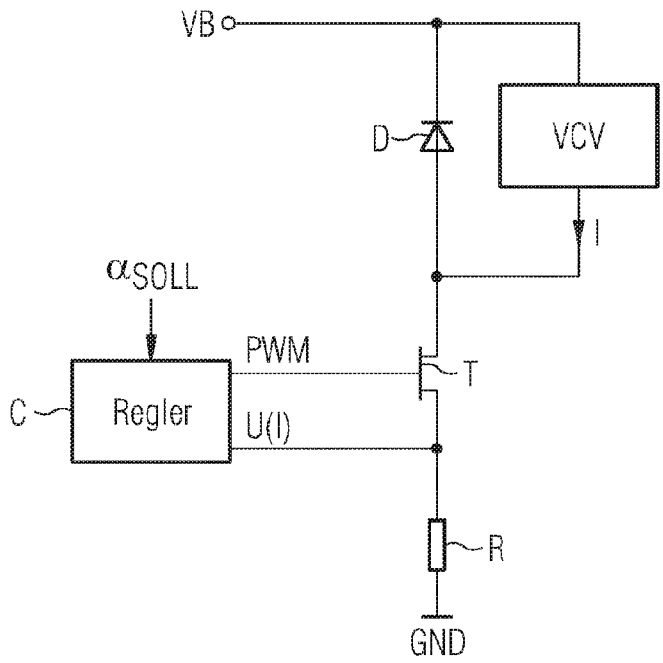
FIG. 1 shows a greatly simplified circuit diagram of a control device according to various embodiments for operating a volume control valve of an injection system for an internal combustion engine.

According to various embodiments, for operating an actuator (e.g. a volume control valve in an injection system) with a pulse width modulated control signal, the current flowing through the actuator is switched off if the current exceeds a predefined limit value. In contrast to the known regulating method described in the introduction, control is effective not only from period to period, but even within a period, so that the regulating method is virtually lag-free.

The regulating method according to various embodiments differs from the conventional regulating method described in the introduction in that the current flowing through the actuator is measured not only at a predefined instant at the end of the period, but even before the end of the period in order to detect when the current flowing through the actuator exceeds the predefined current limit value. The current flowing through the actuator is preferably measured throughout the period of the pulse width modulated control signal. However, it is also possible for the current flowing through the actuator not to be measured throughout the period of the pulse width modulated control signal, but only during the phase of the pulse width modulated control signal in which the current is flowing through the electric actuator.

Within the framework of the regulating method according to various embodiments, a setpoint value for a manipulated variable of the actuator is preferably first predefined. This can be, for example, the degree of opening of a volume control valve in an injection system for an internal combustion engine.

A corresponding current limit value is then determined according to the predefined setpoint value, as in the case of a volume control valve, for example, the electric current flowing through the volume control valve is a measure of the degree of opening of the volume control valve.

A pulse width modulated electrical control signal with a predefined duty factor and a predefined period is then applied to the actuator in order to set the required setpoint value of the manipulated variable.

While it is being applied, the current flowing through the actuator is continuously compared with a predefined current limit value, it being possible for the current to be measured continuously or discontinuously. However, in each case current measurement must take place at sufficiently short intervals in order to enable the current to be shut off sufficiently rapidly.

As part of the regulating method according to various embodiments, the current flowing through the actuator is then switched off even before the end of the period of the control signal if the current measured exceeds the predefined current limit value. In this way the predefined setpoint value for the manipulated variable of the actuator is set in a highly dynamic manner with no dead times. In addition, interfering effects such as temperature fluctuations, for example, no longer need to be corrected by precontrol.

If a predefined current limit value is exceeded, the current flowing through the actuator may be preferably switched off by a level change in the pulse width modulated control signal, resulting in a corresponding change in the duty factor.

The pulse width modulated control signal therefore preferably may have a constant period, the duty factor being changed according to the required setpoint value during each individual period. In addition, the current limit value may also preferably be set as a function of the required setpoint value of the manipulated variable so that the current limit value can fluctuate over time according to the required setpoint value of the manipulated variable. However, the current limit value is here preferably independent of the comparison of the measured current with the current limit value, i.e. the instant of limit value overshoot within the period has no effect on the current limit value of the subsequent cycle of the pulse width modulated control signal.

The current flowing through the actuator may preferably be measured by means of an analog-digital-converter, which is sufficiently known per se in the prior art and does not therefore need to be described in greater detail.

It has already been mentioned above that the actuator is preferably a volume control valve in an injection system of an internal combustion engine, the manipulated variable being the degree of opening of the volume control valve. However, the invention is not limited to volume control valves in respect of the actuator, but can also be implemented e.g. with other actuators in injection systems. The regulating method according to various embodiments can therefore be used generally for valves in injection systems of internal combustion engines.

In these cases the period of the control signal in generally in the millisecond range, in particular in the range from 1 to 10 milliseconds, a control frequency of 200 Hertz having been found advantageous.

It should also be mentioned that the invention not only encompasses the above described regulating method, but also a computer program product which executes the regulating method according to the invention when loaded onto and run on an appropriate control computer.

Lastly, the invention also encompasses a control computer for an injection system of an internal combustion engine, comprising a program memory and, stored in said program memory, a computer program which executes the regulating method according to various embodiments.

The circuit diagram in FIG. 1 shows a greatly simplified circuit for operating a volume control valve VCV in an injection system for an internal combustion engine.

The volume control valve VCV in connected on its voltage side to a battery voltage VB which is supplied by the electrical system of a motor vehicle. This voltage can be +12 V, for example.

On the ground side, however, the volume control valve VCV is connected to ground GND via an output stage T only shown schematically here and a resistor R connected in series with the output stage T.

Connected in parallel with the volume control valve VCV is a so-called free-wheeling diode D, which is known per se from the prior art.

The output stage T is driven by a controller C using a pulse width modulated control signal PWM, the output stage T being low-active, i.e. the output stage T is activated when the control signal PWM assumes a low level, whereas the output stage T is deactivated when the pulse width modulated control signal PWM goes high.

On the input side, the controller C receives a setpoint value $\alpha_{SETPONT}$ for the degree of opening of the volume control valve VCV, it being possible for said setpoint value $\alpha_{SETPONT}$ to be provided e.g. by the ECU (Electronic Control Unit) of the internal combustion engine.

The regulating method according to various embodiments will now be described with reference to the other figures.

In a first step S1, as already mentioned above, the controller C receives the setpoint value $\alpha_{SETPONT}$ for the degree of opening of the volume control valve VCV.

In another step S2, the controller C then determines, from the predefined setpoint value $\alpha_{SETPONT}$ for the degree of opening of the volume control valve VCV, an appropriate current limit value $I_{MAX}$ which must not be exceeded, in order to set the wanted degree of opening $\alpha_{SETPONT}$.

In a further step S3, the controller C then applies the pulse width modulated control signal PWM with a constant frequency of 200 Hz to the output stage T, the controller C being able to vary the duty factor of the pulse width modulated control signal PWM in order to set the desired degree of opening.

During activation of the output stage T by the pulse width modulated control signal PWM, the controller C then continuously measures, in a step S4, the voltage U(I) dropped across the resistor R and therefore representing the current I flowing through the volume control valve VCV.

In doing so, the controller C checks, in a step S5, whether the current I flowing through the volume control valve VCV exceeds the predefined current limit value $I_{MAX}$.

If the current limit value $I_{MAX}$ is exceeded, in a step S6 the controller C switches off the current I through the volume control valve VCV by causing the pulse width modulated control signal PWM to go high so that the low-active output stage T is turned off.

If, on the other hand, the predefined current limit value $I_{MAX}$ is not exceeded, the controller C ends the relevant cycle without changing the duty factor.

Figure 2:
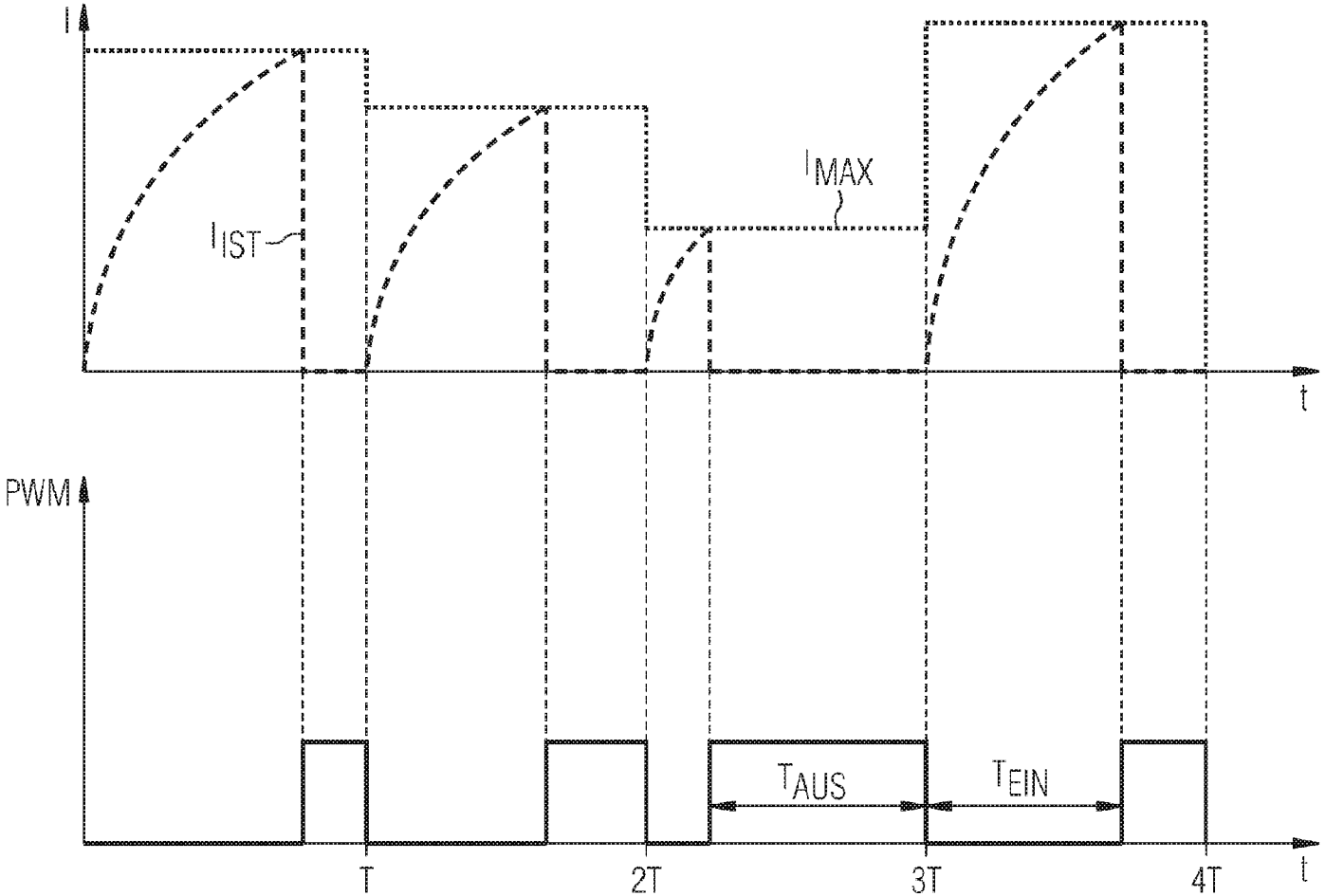
FIG. 2 shows several timing diagrams which plot the behavior over time of the current flowing through the volume control valve, of the current limit value and of the pulse width modulated control signal.
Figure 3:
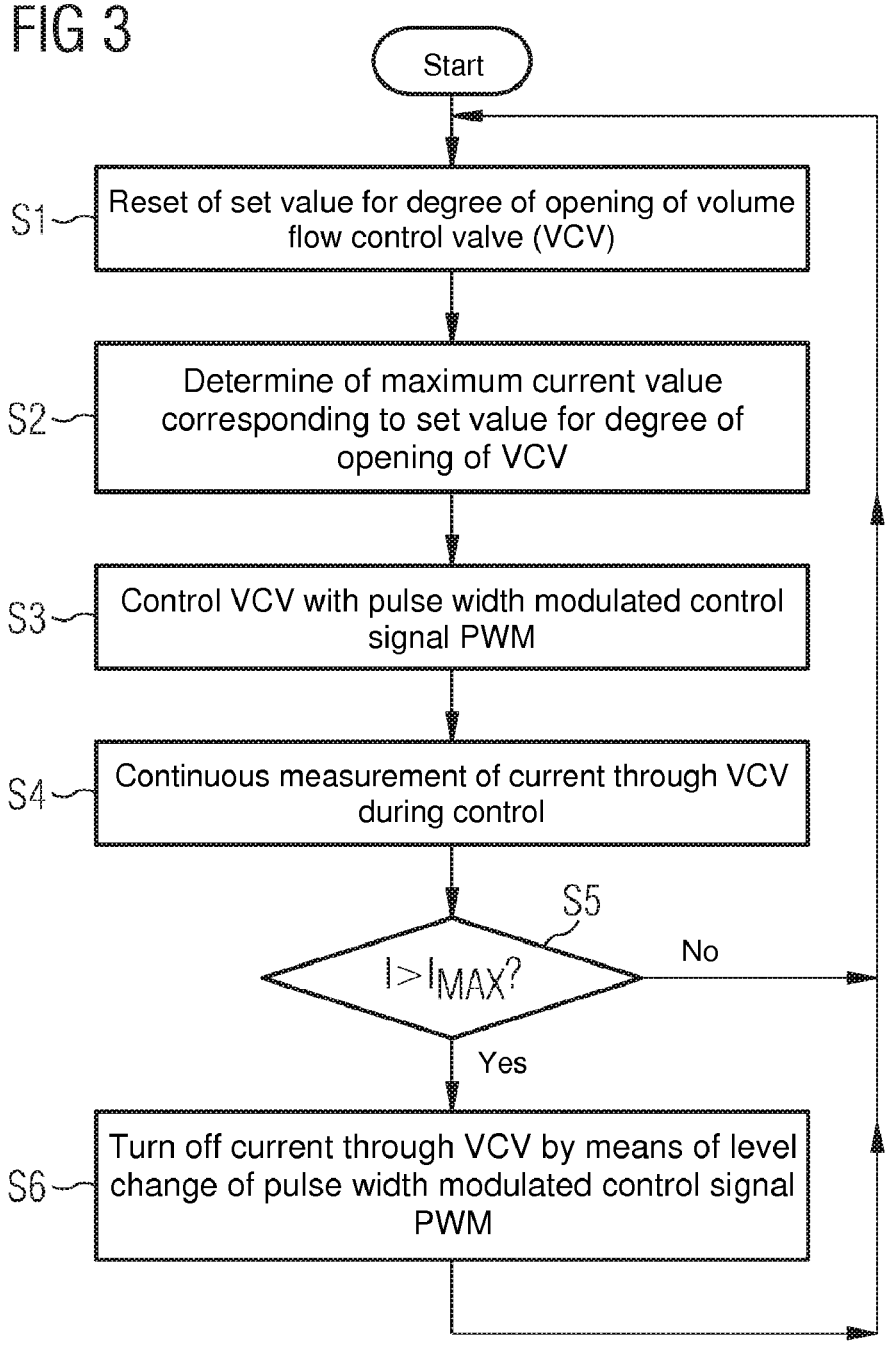
FIG. 3 shows the regulating method according to an embodiment in the form of a flow chart.

The timing diagram in FIG. 2 also shows that the current limit value $I_{MAX}$ can be varied from period to period in order to set a desired temporal opening characteristic of the volume control valve VCV.

It is also clear from the timing diagram in FIG. 2 that the output stage T is controlled with a constant period, only the duty factor being set according to the relevant current behavior in each cycle.

The invention is not limited to the exemplary embodiment described above. In fact a large number of variants are possible which likewise make use of the inventive concept and therefore come within the scope of the protection sought.

LIST OF REFERENCE CHARACTERS $\alpha_{SETPONT}$ setpoint value of the degree of opening of the volume control valve
C controller
D free-wheeling diode
I current through the volume control valve
$I_{MAX}$ current limit value
PWM pulse width modulated control signal
R resistor
T output stage
U(I) voltage drop across the resistor
VB battery voltage
VCV volume control valve

What is claimed is:

1. A regulating method for operating an electric actuator comprising the following steps:
a) Predefining a setpoint value for a manipulated variable of the actuator,
b) Operating the actuator with a pulse width modulated electrical control signal having a predefined duty factor and a predefined period for setting the desired setpoint value of the manipulated variable,
c) Determining a current limit value corresponding to the predefined setpoint value for the manipulated variable,
d) Continuously measuring the current flowing through the actuator while the control signal is being applied,
e) Comparing the measured current with the current limit value, and
f) Switching off the current flowing through the actuator if the current measured exceeds the current limit value.

2. The regulating method according to claim 1, wherein, to switch off the current through the actuator, the level of the pulse width modulated control signal is changed, resulting in a corresponding change in the duty factor.

3. The regulating method according to claim 1, wherein the pulse width modulated control signal has a constant period.

4. The regulating method according to claim 1, wherein the current limit value is variably set as a function of the required setpoint value.

5. The regulating method according to claim 1, wherein current limit value is independent of the comparison of the measured current with the current limit value.

6. The regulating method according to claim 1, wherein the current flowing through the actuator is measured by means of an analog-digital-converter.

7. The regulating method according to claim 1, wherein
a) the actuator is a volume control valve in an injection system of an internal combustion engine, and
b) the manipulated variable is the degree of opening of the volume control valve.

8. The regulating method according to claim 1, wherein the period of the control signal is in the millisecond range.

9. The regulating method according to claim 1, wherein the period of the control signal is in the range from 1 ms to 10 ms.

10. The regulating method according to claim 1, wherein the electric actuator is a volume control valve in an injection system for an internal combustion engine.

11. A computer program product comprising a computer-readable medium in which program instructions are stored, which instructions, when read by a control computer, cause the control computer to perform a regulating method including:
a) Predefining a setpoint value for a manipulated variable of the actuator,
b) Operating the actuator with a pulse width modulated electrical control signal having a predefined duty factor and a predefined period for setting the desired setpoint value of the manipulated variable,
c) Determining a current limit value corresponding to the predefined setpoint value for the manipulated variable,
d) Continuously measuring the current flowing through the actuator while the control signal is being applied,
e) Comparing the measured current with the current limit value, and
f) Switching off the current flowing through the actuator if the current measured exceeds the current limit value.

12. A control computer for an injection system of an internal combustion engine, comprising a program memory and, stored in said program memory, a computer program which operates an electric actuator by:
a) Predefining a setpoint value for a manipulated variable of the actuator,
b) Operating the actuator with a pulse width modulated electrical control signal having a predefined duty factor and a predefined period for setting the desired setpoint value of the manipulated variable,
c) Determining a current limit value corresponding to the predefined setpoint value for the manipulated variable,
d) Continuously measuring the current flowing through the actuator while the control signal is being applied,
e) Comparing the measured current with the current limit value, and
f) Switching off the current flowing through the actuator if the current measured exceeds the current limit value.

13. The control computer according to claim 12, wherein, to switch off the current through the actuator, the level of the pulse width modulated control signal is changed, resulting in a corresponding change in the duty factor.

14. The control computer according to claim 12, wherein the pulse width modulated control signal has a constant period.

15. The control computer according to claim 12, wherein the current limit value is variably set as a function of the required setpoint value.

16. The control computer according to claim 12, wherein current limit value is independent of the comparison of the measured current with the current limit value.

17. The control computer according to claim 12, wherein the current flowing through the actuator is measured by means of an analog-digital-converter.

18. The control computer according to claim 12, wherein
a) the actuator is a volume control valve in an injection system of an internal combustion engine, and
b) the manipulated variable is the degree of opening of the volume control valve.

19. The control computer according to claim 12, wherein the period of the control signal is in the range from 1 ms to 10 ms.

20. The control computer according to claim 12, wherein the electric actuator is a volume control valve in an injection system for an internal combustion engine.

* * * * *